US012529241B2

(12) United States Patent
Olsson et al.

(10) Patent No.: US 12,529,241 B2
(45) Date of Patent: Jan. 20, 2026

(54) METHOD OF ANCHORING POSTS

(71) Applicant: CLIPEX IP LIMITED, Tortola (VG)

(72) Inventors: Ashley Dean Olsson, Goulburn (AU); Ashley Norman Olsson, Goulburn (AU); Nathanael Dean Olsson, Goulburn (AU)

(73) Assignee: Clipex IP Limited, Virgin Islands (GB)

( * ) Notice: Subject to any disclaimer, the term of this patent is extended or adjusted under 35 U.S.C. 154(b) by 443 days.

(21) Appl. No.: 18/014,532

(22) PCT Filed: Jul. 8, 2021

(86) PCT No.: PCT/AU2021/050727
§ 371 (c)(1),
(2) Date: Jan. 5, 2023

(87) PCT Pub. No.: WO2022/006631
PCT Pub. Date: Jan. 13, 2022

(65) Prior Publication Data

US 2023/0265677 A1 Aug. 24, 2023

(30) Foreign Application Priority Data

Jul. 8, 2020 (AU) ..... 2020902349

(51) Int. Cl.
*E04H 17/26* (2006.01)

(52) U.S. Cl.
CPC ..... *E04H 17/263* (2013.01); *E04H 17/266* (2013.01)

(58) Field of Classification Search
CPC ..... E04H 17/26; E04H 17/263; E04H 17/266; E04H 12/347; E02D 7/06; E02D 7/16; B25D 17/32
See application file for complete search history.

(56) References Cited

U.S. PATENT DOCUMENTS 2,244,899 A * 6/1941 Smith ..... E04H 17/263 254/387
2,851,248 A 9/1958 Toselio
3,507,338 A * 4/1970 Alexander ..... E04H 12/34 173/195

(Continued)

FOREIGN PATENT DOCUMENTS

AU 2018204064 A1 1/2019
DE 2122334 A1 * 11/1972

(Continued)

OTHER PUBLICATIONS

International Search Report and Written Opinion dated Sep. 27, 2021 in International Patent Application No. PCTAU2021/050727, pp. 1-10.

(Continued)

*Primary Examiner* — Jonathan P Masinick
(74) *Attorney, Agent, or Firm* — Byrne Poh LLP

(57) ABSTRACT

A method of ground anchoring a plurality of posts (11), especially to erect a fence or barrier. The method includes anchoring a first plurality of posts (11) into the ground, preferably simultaneously, using a plurality of post anchoring stations (50) located on at least one movable platform (10) that can be moved along a path, and then anchoring a second plurality of posts (11), again preferably simultaneously, into the ground using the plurality of post anchoring stations (50). In preferred forms there are a plurality of movable platforms which may be mechanically and/or wireless linked.

16 Claims, 10 Drawing Sheets

(56) References Cited

U.S. PATENT DOCUMENTS

| | | | | | |
|---|---|---|---|---|---|
| 3,696,625 | A * | 10/1972 | Alexander | E21B 7/021 173/27 |
| 5,490,568 | A | 2/1996 | Rios et al. | |
| 5,794,387 | A * | 8/1998 | Crookham | F21V 21/36 52/749.1 |
| 6,591,919 | B1 * | 7/2003 | Herrmann | E02D 7/10 173/27 |
| 9,834,950 | B2 * | 12/2017 | Carlos De Alvarenga | E04H 12/347 |
| 11,713,591 | B2 * | 8/2023 | Tanner | E02D 7/08 173/28 |
| 11,873,655 | B2 * | 1/2024 | Brawner | B65H 49/327 |
| 2016/0138299 | A1 | 5/2016 | Powers, III | |
| 2019/0234037 | A1 * | 8/2019 | Canteri | E02D 7/06 |
| 2020/0039556 | A1 * | 2/2020 | Burch, V | B62B 5/048 |
| 2023/0265677 | A1 * | 8/2023 | Olsson | E04H 17/263 175/57 |
| 2024/0040993 | A1 * | 2/2024 | Brauer | A01K 29/005 |
| 2024/0133137 | A1 * | 4/2024 | Hudson | E04H 17/263 |

FOREIGN PATENT DOCUMENTS

| | | | | |
|---|---|---|---|---|
| DE | 2235287 | A1 * | 1/1974 | |
| DE | 102004018385 | A1 * | 11/2005 | E04H 17/263 |
| EP | 1130169 | A1 | 9/2001 | |
| FR | 2861064 | A1 * | 4/2005 | B62B 21/264 |
| GB | 1167061 | A * | 10/1969 | |
| GB | 2485918 | A * | 5/2012 | E04H 17/263 |
| GB | 2534295 | A * | 7/2016 | E04H 17/263 |
| WO | WO 2020/070418 | A1 | 4/2020 | |

OTHER PUBLICATIONS

Supplementary European Search Report dated Jul. 26, 2024 in EP Patent Application No. 21838391.7, pp. 1-10.

* cited by examiner

METHOD OF ANCHORING POSTS

CROSS REFERENCE TO RELATED APPLICATIONS

This application is a U.S. national state under 35 U.S.C. § 371 of International Application No. PCT/AU2021/050727, filed Jul. 8, 2021, which claims priority from Australia Patent Application No. AU 2020902349, filed Jul. 8, 2020, each of which is hereby incorporated by reference herein in its entirety.

FIELD OF THE INVENTION

This invention relates to a method of anchoring posts, especially for anchoring posts to erect a fence. In particular, the invention relates to erecting a fence made of posts and wires.

BACKGROUND OF THE INVENTION

There are many occasions where a multiplicity of posts are required to be anchored into the ground along a set path or line. The posts can be used for multiple purposes. In many applications they can be used to delineate between two areas of land or boundaries, such as a railway line or motorway. One such particular use of delineation is in the agriculture industry where farmers separate paddocks from each other or from roadways and neighbouring properties with one or more demarcation lines in the form of a fence. Many cattle and sheep properties located throughout the world cover vast areas. For example, the largest cattle station in Australia is Anna Creek Station, located in South Australia, which is roughly 24,000 square kilometres (9,300 sq mi) in area. Fences are located on most stations and farms to keep livestock in as well as to provide a barrier to entry against invasive species such as dingoes, kangaroos and emus, which damage crops, as well as wild dogs which attack livestock. Another use of a delineation barrier or fence is to prevent specific animals from gaining access to roads and railway lines. In Australia for example, specially designed barriers are erected to prevent koalas climbing the barrier, thereby limiting their access to road and railway corridors.

Fences can extend 10's to 100's of kilometres in length. To install a fence can take from days to weeks for a short fence, to weeks or months for long fences. To erect an agricultural fence, strainer posts are anchored into the ground, fence posts are anchored at predetermined spacings and depending on the length of the individual span between strainer posts, the barrier material that is being suspended and the terrain over which the fence runs, additional mid support posts may be required. Strands of material, including those used for conducting electricity such a woven metallic, carbon and synthetic fibre, plain wire or barbed wire or fabricated and woven wire mesh, or any combination of all types of strands, act as barrier materials and need to be uncoiled along the fence line, connected to the strainer posts, and any support posts. The strands must be secured to the posts using a retention mechanism. The retention mechanism may, for example, comprise one or more of an aperture, a slot, a retainer device such as a clip, insulator, staple or a tie wire to complete the erection of the fence.

In other applications there are required to be installed a multiplicity of vertical uprights to act as visual or physical delineations or supports for various physical barriers or acting as visual demarcations. These demarcations and lines of delineation may be made or constructed using a variety of materials, including natural materials and manufactured materials.

As stated above, there are multiple aspects to building a delineation or demarcation, especially the erection of physical barriers between sections of land, and there are often multiple movements along the demarcation line in both directions to complete the installation. These movements can include the use of vehicles, 4wds, tracked machines, all-terrain vehicles, sleds and trailers or may be conducted on foot. A major time component in erecting a fence or demarcation line is the anchoring of support posts into the ground. A relatively short fence of 10 km in length can have up to 3,000 support posts that need to be anchored into the ground. Each support post is anchored along a predetermined line. In agricultural fences the strands of material that will act as a barrier are suspended between ground anchored strainer posts and supported by other ground anchored supports fixed at a predetermined spacing and each ground anchored support is normally required to be substantially vertical in both the lateral and longitudinal direction. To achieve both a visually satisfactory and commercially viable result is time-consuming.

Ground anchored supports and posts can be anchored into the ground manually using cementitious based substances, rammed earth, a manual handheld post driver or sledgehammer. However, today most ground anchored supports will be installed using a hydraulic, pneumatic, or fuel-driven, handheld or machine mounted anchoring processes. In longer fences, larger specialised post anchoring vehicles can be used to anchor posts more quickly. The vehicle can often travel along the predetermined fence line and anchor the support post at the predetermined distances. Further, the posts can be anchored substantially vertically using an in-built level located on the anchoring machinery that forms part of the vehicle. However, even with the use of specialised vehicles of this nature, there is often a need to traverse the fence line several times to complete each of the processes required to construct the complete fence. Accordingly there is a desire to anchor demarcation members and support posts and erect fences more quickly.

OBJECT OF THE INVENTION

It is an object of the invention to overcome or alleviate the abovementioned problems and/or provide the consumer with a useful or commercial choice.

SUMMARY OF THE INVENTION

In one form, although not necessarily the only or broadest form, the invention resides in a method of ground anchoring a plurality posts for erecting a fence, the method including the steps of:

anchoring a first plurality of posts into the ground using a plurality of post anchoring stations, the post anchoring stations being located on at least one movable platform;

moving the at least one movable platform along a predetermined path;

anchoring a second plurality of posts into the ground using the plurality of post anchoring stations.

The first plurality of posts may be anchored substantially simultaneously. The second plurality of posts may be anchored substantially simultaneously.

Typically, there are at least two operatively connected movable platforms. Preferably the at least two movable platforms are aligned along the predetermined path. The two or more movable platforms are preferably configured to follow along the predetermined path by being operatively connected to each other. The movable platforms may form a series of platforms. Each movable platform in the series may be operatively connected through mechanical interconnection or may be mechanically independent and operatively connected through a communication system (e.g. wireless communication including, but not limited, to GPS, laser and other spatial positioning and guidance systems). The plurality of platforms may also be operatively connected through both mechanical interconnection and the communication system. The movable platforms may be configured to be interconnected with any of the other movable platforms to have an at least one leading platform and at least one trailing platform creating a series of independent moving platforms or a series of interconnected moving platforms or trailers capable of following substantially along the same desired path.

Each interconnected movable platform may be articulated with respect to other movable platforms. Typically, there are between 2 and 15 movable platforms. The movable platforms are preferably configured to operate substantially in unison, such that each movable platform follows substantially along the predetermined path with each one of the movable platforms following behind the other. Preferably each movable platform is capable of operating and substantially following the other movable platforms along the predetermined path by being operatively connected with the other movable platforms operating in substantial unison. The movable platforms may be designed and configured in such a way that each movable platform is capable of operating substantially following in the pathway of the proceeding movable platform so that should multiple movable platforms be operating in such a manner as to form a chain of movable platforms the last movable platform follows, or at least substantially follows, the path of the first movable platform making navigation and manoeuvring easier and more accurate.

Each movable platform may have a propulsion unit configured to move the movable platform along the predetermined path. Alternatively, each movable platform in a mechanically interconnected series of movable platforms may use less propulsion units than there are movable platforms, with at least a portion of the movable platforms being towed. For example, a single source of propulsion may be contained within any one of the movable platforms or contained externally in an independent source of propulsion such as a four-wheel drive vehicle, truck or tractor or other such vehicle capable of moving the series of interconnected movable platforms along a desired path or line and stopping as required to allow the ground anchoring activities to be performed. The propulsion unit may be manually driven, semi-autonomously driven, or fully autonomously controlled to follow, or at last substantially follow, the predetermined path.

The multiplicity of posts that are to be anchored into the ground, preferably substantially simultaneously, may each be of an identical form such as, for example, a Y picket, star picket, T post, hollow round section tube, rolled sheet metal profile section, screw-in base type, timber, plastic, alloy or other form of suitable support member. Alternatively each individual post to be anchored into the ground can be a different configuration to each of the other posts being substantially simultaneously anchored into the ground. The posts being installed into the ground may be support posts or strainer posts. The strainer posts may be end strainer posts or mid strainer posts. The post anchoring stations may be spaced in series with the same distance between each anchoring station or be spaced at varying distances between each anchoring station, to enable the posts to be installed at varying centre distances along the predetermined path.

The distance between respective post anchoring stations may be independently varied. This may be achieved by moving the post anchoring station position on the movable platforms or changing the spacing between each or any one or more of the movable platforms. This may allow a predetermined spacing of the posts to be changed. The predetermined spacing between the posts is typically between 2 and 12 meters. More preferably, the spacing between the posts is between 3 and 10 meters.

Each post anchoring station may include a post anchoring mechanism that can be manually operated, semi-autonomously operated, or fully autonomously controlled. In the semi-autonomous or fully autonomous anchoring mechanism, posts may be automatically loaded into the anchoring mechanism. The post anchoring mechanism may be of any suitable design that is capable of completing the ground anchoring process. Such mechanisms may include screw-type, rotating auger, single percussion, cementitious based materials placement, a reciprocating percussion type of anchoring mechanism, or a combination of any of the mechanisms depending on the type of post being utilised and the condition of the ground that is anchoring the post.

Each post anchoring mechanism may be independently capable of adjustment such that it can be configured to be operated on either side of the movable platform to enable the step of anchoring a first plurality of posts into the ground on either side of the movable platform when following a predetermined or intended line of travel. The adjustment of the post anchoring mechanism can be achieved manually or by any suitable mechanical means including an electric motor, servo motor, hydraulic or air driven actuator, or electro-mechanical system.

Each post anchoring mechanism may be independently capable of adjustment such that it can extend or retract on a substantially horizontal plane perpendicularly from the movable platform towards or away from the intended fence line, or the intended post anchoring pathway to ensure that each post is anchored on an intended fence line or anchoring pathway. The adjustment can be achieved manually or by any other suitable means including an electric motor, servo motor, electric actuator, hydraulic or air cylinder, air or hydraulic actuator, or other electro-mechanical actuating system.

Each post anchoring mechanism may be independently capable of adjustment such that each post is anchored substantially perpendicularly meaning that each post is anchored substantially vertically upright in both the lateral and longitudinal direction regardless of the ground angle or inclination angle of the movable platform. The adjustment of the post anchoring mechanism can be achieved manually or by any other suitable means including an electric motor, servo motor, electric actuator, hydraulic or air cylinder, air or hydraulic actuator, or other electro-mechanical system.

Each independent post anchoring mechanism is preferably independently adjustable so that a multiplicity of posts can be substantially simultaneously anchored plumb along a predetermined pathway or fence line.

In another form, the invention resides in a method of erecting a fence, the method including the steps of: anchoring a first plurality of posts into the ground using a plurality of post anchoring stations, the post anchoring stations being located on at least one movable platform; moving the at least one movable platform along a predetermined fence line;

stopping and anchoring a second plurality of posts into the ground using the plurality of post anchoring stations; laying out at least one strand of barrier material adjacent the first plurality of posts and adjacent the second plurality of posts straining the at least one strand of barrier material; and attaching the at least one strand of barrier material to the first plurality of posts and the second plurality of posts.

The at least one movable platform preferably comprises a plurality of operatively connected movable platforms. The plurality of movable platforms may be operatively connected through mechanical interconnection and/or through a communication system (e.g. wireless communication preferably including positioning apparatus such as, but not limited to, GPS, laser and other spatial positioning and guidance systems). The at least one movable platform may include an aligned series of mechanically independent or interconnected movable platforms. The movable platforms may be articulated with respect to each other. Typically, there are between 2 and 15 movable platforms.

The first plurality of posts may be anchored substantially simultaneously. The second plurality of posts may be anchored substantially simultaneously.

Typically there are at least two movable platforms. The movable platforms may be formed by a series of mechanically independent or interconnected movable platforms following each other with each movable platform being configured to following substantially the same defined pathway or fence line. The movable platforms may be designed and configured in such a way that each movable platform is capable of following substantially in the pathway of a proceeding movable platform so that multiple movable platforms follow a desired pathway or fence line in either a mechanically interconnected or disconnected fashion in such a manner as to form a chain of movable platforms where the last movable platform follows substantially in the path of the first movable platform making navigation and manoeuvring easier and more accurate Each movable platform may have its own form of propulsion to move along the desired path. Alternatively each movable platform, when operating in a mechanically interconnected series of movable platforms, may use a single source of propulsion being contained within any one of the movable platforms or contained externally in an independent source of propulsion such as a four-wheel drive vehicle, truck or tractor or other such vehicle capable of moving and stopping the series of interconnected movable platforms. The propulsion unit be it contained within the movable platform or contained in an external source to the movable platform may be manually driven, semi-autonomously driven, or fully autonomously controlled to follow or substantially follow a path.

The multiplicity of substantially simultaneously anchored posts that are to be anchored into the ground may each be of an identical configuration such as Y picket or star picket or T post or hollow round section tube, rolled sheet metal section, screw-in base type, timber, plastic, alloy or other suitable support member. Alternatively, each individual post to be anchored can be a different configuration to each of the other posts being substantially simultaneously anchored and each post may be of a type such as a Y picket or star picket or T post or hollow tubular section, rolled sheet metal section, screw in base type, timber, plastic, alloy or other suitable support member.

The posts being installed may be support posts or strainer posts. The strainer posts may be end strainer posts or mid strainer posts.

The post anchoring stations may be spaced in series with the same distance between each anchoring station or be spaced at varying distances between each anchoring station.

The distance between respective post anchoring stations may be independently varied. This may be achieved by moving the post anchoring station position on the movable platforms (relative to other post anchoring stations on the same or other moveable platforms) or changing the spacing between movable platforms. This may allow the predetermined spacing of the posts to be changed. The predetermined spacing between the posts is typically between 2 and 12 meters. More preferably, the spacing between the posts is between 3 and 10 meters.

Each post anchoring station may include a post anchoring mechanism. The anchoring mechanism may be manually operated, semi-autonomously operated, or fully autonomously controlled. In the semi-autonomous or fully autonomous anchoring mechanism, posts may be automatically loaded into the anchoring mechanism.

The post anchoring mechanism may be of a screw-type, single percussion, rotating auger, single percussion, cementitious based materials placement, or a reciprocating percussion type of anchor mechanism, or a combination of any of the mechanisms, depending on the type of post being utilised and the condition of the ground that is anchoring the post.

Each post anchoring mechanism may be independently capable of adjustment such that it can be configured to be operated on either side of the movable platform to enable the erection of fences on either side of the movable platform when following a predetermined or intended line of travel. The adjustment can be achieved manually or by any suitable mechanical means including an electric motor, servo motor, hydraulic or air driven actuator or electro-mechanical system.

Each post anchoring mechanism may be independently capable of adjustment such that it can extend or retract perpendicularly from the movable platform towards or away from the intended fence line or pathway to ensure that each post is anchored on the intended fence line or pathway. The adjustment can be achieved manually or by any other suitable means including an electric motor, servo motor, electric actuator, hydraulic or air cylinder, air or hydraulic actuator or other electro-mechanical system.

Each post anchoring mechanism may be independently capable of adjustment such that each post is anchored substantially perpendicularly meaning that each post is anchored substantially vertically upright in both the lateral and longitudinal direction regardless of the ground angle or inclination angle of the movable platform. The adjustment can be achieved manually or by any other suitable means including an electric motor, servo motor, electric actuator, hydraulic or air cylinder, air or hydraulic anchor actuator or other anchor electro-mechanical system. Each independent post anchoring mechanism is independently adjustable so that a multiplicity of posts can be substantially simultaneously anchored substantially plumb along a predetermined pathway or fence line.

Any suitable barrier material may be located on or dispensed from at least one movable platform. The suitable barrier material, may be dispensed or fed from the at least one movable platform adjacent the predetermined pathway or fence line.

The barrier material may be strained using mid-strainer posts and/or end strainer posts. The barrier material may be wire, wire strands, or wire mesh.

In yet another form, the invention resides in a multi vehicle train that is used to anchor posts, the multi vehicle train comprising:

a plurality of operatively connected movable platforms; and a plurality of post anchoring stations, each including post anchoring station including a post anchoring mechanism;

wherein at least one post anchoring station is located on at least two or more of the plurality of movable platforms.

One of the movable platforms may be used to mount at least one barrier material feeder.

Further features of the invention will become apparent from the detailed description below.

BRIEF DESCRIPTION OF THE DRAWINGS

An embodiment of the invention will be described, by way of example only, with reference to the accompanying figures in which.

DETAILED DESCRIPTION OF THE PREFERRED EMBODIMENTS

Like numerals have been used to describe like components in the description below.

Figure 1:
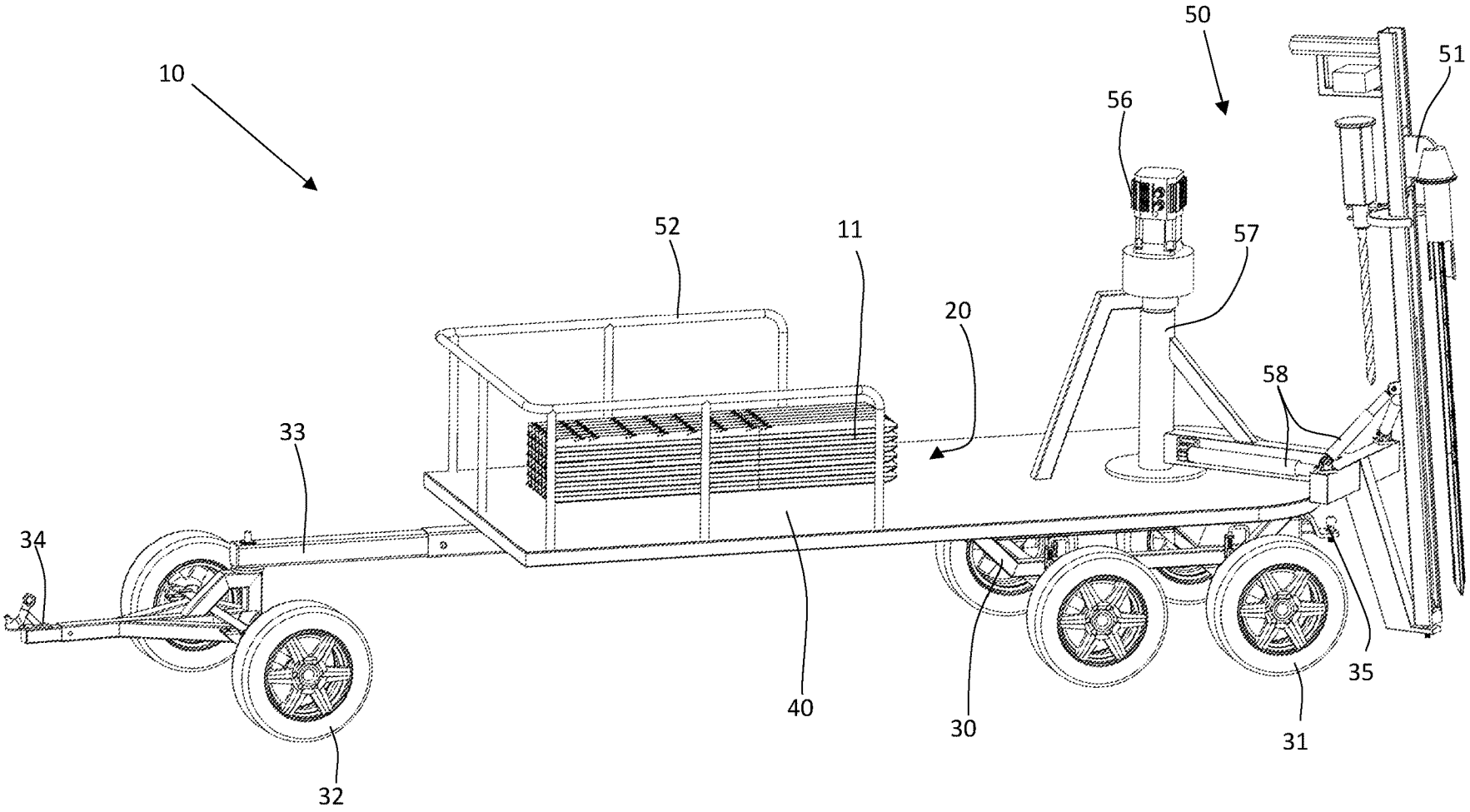
FIG. 1 is a perspective view of a first embodiment of a movable platform according to an embodiment of the invention.

FIG. 1 shows a movable platform 10 that has been configured to anchor posts into the ground quickly, easily and accurately.

The movable platform 10 includes a movable platform 20 formed by a chassis 30 on which is mounted a floor 40. The chassis 30 includes four rear wheels 31 mounted adjacent the end of the floor 40 and two front wheels 32 located forward of the floor 40. The distance between the front wheels 32 and the rear wheels 31 can be adjusted using a telescopic arm 33. A trailer hitch 34 is located at the adjacent the front wheels 32 and a tow ball 35 is located adjacent the rear wheels 31.

It would be appreciated that there are many ways to create a movable platform that would be known to a person skilled in the art. The representation of the wheels as a method providing movement as shown is purely for illustrative purposes only and is not meant to limit the scope of the movable platform. Other forms can include continuous rubber tracked or steel plate tracked mechanisms such as found on skid steer equipment and bulldozers.

An interconnected movable platform configuration has been illustrated, however the invention should not be limited to this configuration, as it is described in this specification and intended and claimed that each movable platform can be autonomous and independently capable of substantially following the path of the at least one other leading movable platform. Where there are more than two movable platforms it is claimed that each movable platform is capable of following substantially along the same path as the first leading movable platform and capable of operating substantially in unison with each of the other movable platforms even though they are not connected in a similar fashion as that of a train.

An anchoring station 50 is located on the floor 40 of the movable platform 10. The anchoring station 50 includes a post anchoring mechanism 51 located adjacent one end of the floor 40 and a safety railing 52 located adjacent the front of the floor 40. Posts 11 to be anchoring into the ground are located on the floor 40 adjacent the anchoring mechanism 51. It would be appreciated that there are many types of anchoring mechanisms 51 that would be known to a person skilled in the art. The representation shown is purely for illustrative purposes only and is not meant to limit the scope of anchoring mechanisms 51 than may be used.

The anchoring station 50 also includes a rotatable body 57 that is used to mount the post anchoring mechanism 51 via a series of movable arms 58. The rotatable body 57 is connected to the floor 40. A motor 56 is connected to the rotatable body to enable rotation of the rotatable body 57 and hence the post anchoring mechanism 51. Accordingly, the post anchoring mechanism 51 can be rotated, extended, and/or titled with respect to the movable platform 10 using the arms 58. This enables that a post 11 can be anchored into the ground at a desired angle (which is normally vertical).

To anchor a post 11 into the ground, an operator (not shown) who is located on the floor 40, picks up a post 11 located on the trailer 10. The post 11 is placed within the post anchoring mechanism 51. The post anchoring mechanism 51 is then activated, and then the post 11 is anchored into the ground at the desired orientation along a fence line.

Figure 2:
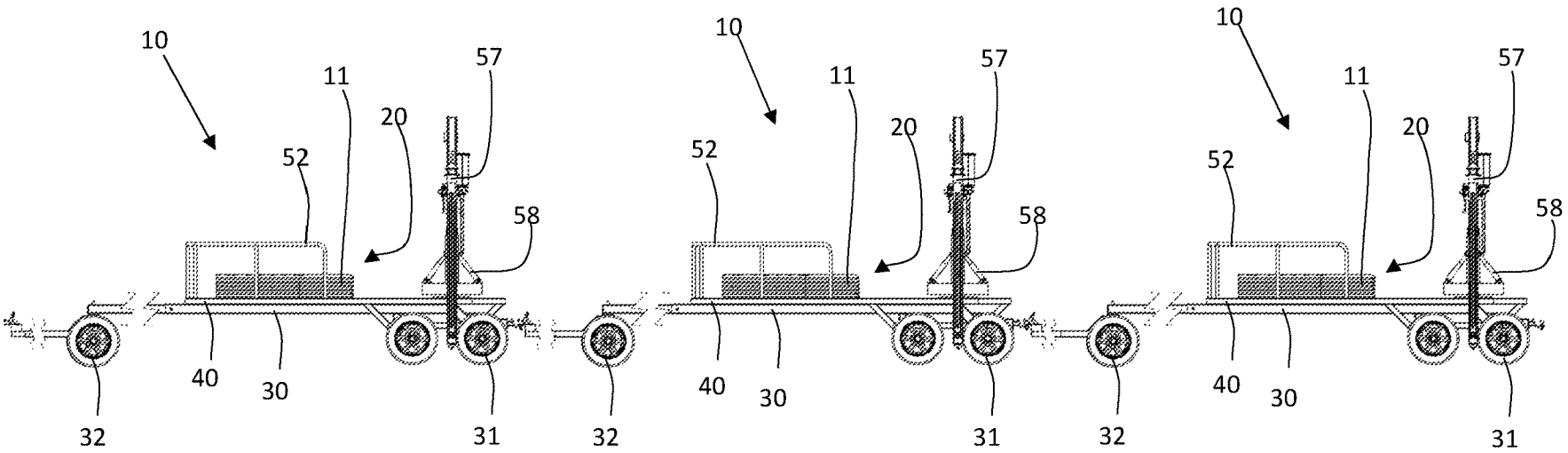
FIG. 2 is a side view of a series of trailers shown in FIG. 1.
Figure 3:
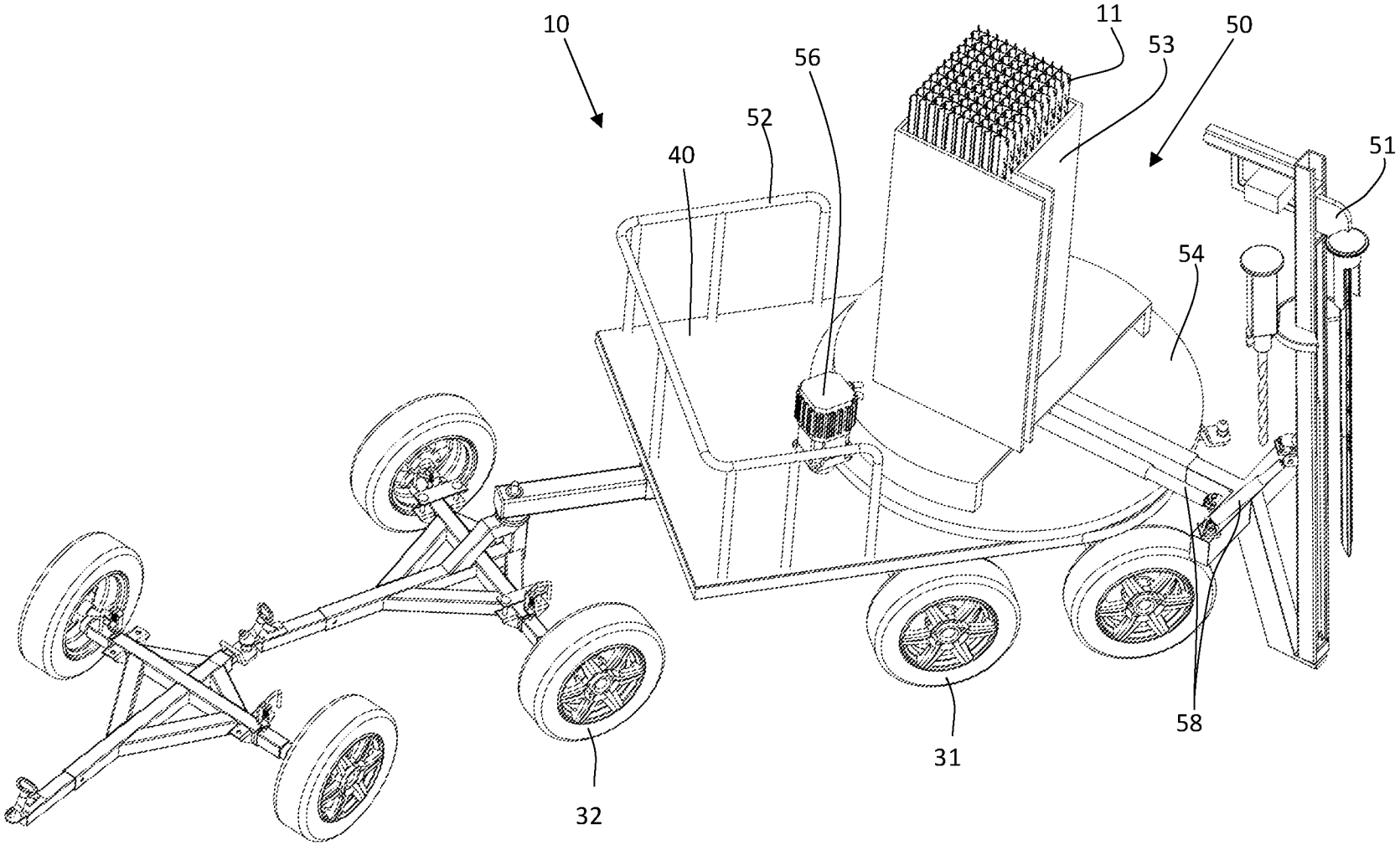
FIG. 3 is a perspective view of a second embodiment of a movable platform according to an embodiment of the invention.

FIG. 2 shows how trailers 10 shown in FIG. 1 can be connected together using trailer hitches 34 and tow balls 35 of adjacent trailers 10. The trailer 10 may come in a variety of different formats. For example, FIG. 3 shows an embodiment of a trailer 10 where the floor 40 of the movable platform 20 is smaller and the chassis 30 is slightly different. The anchoring station 50 is slightly different with the post anchoring mechanism 51 being automated and including an automatic loader 53 for posts 11. Both the automatic loader 53 and post anchoring mechanism 51 are located on a circular dolly 54 which is mounted to the floor 40 and moved by a motor 56.

As the loader 53 and post anchoring mechanism 51 are both automated, a user is not required to be located on the floor 40 of the trailer 10. That is, a post 11 can be loaded and driven into the ground remotely. The circular dolly 54 can be rotated to allow a greater level of movement of the anchoring mechanism 51 if required. FIG. 4A to 4D show a vehicle train 1 that is used to anchor posts into the ground to erect a fence. The vehicle train 1 includes a powered vehicle 2, such as a tractor, and a series of interconnected trailers shown in FIG. 1.

Figure 4A:
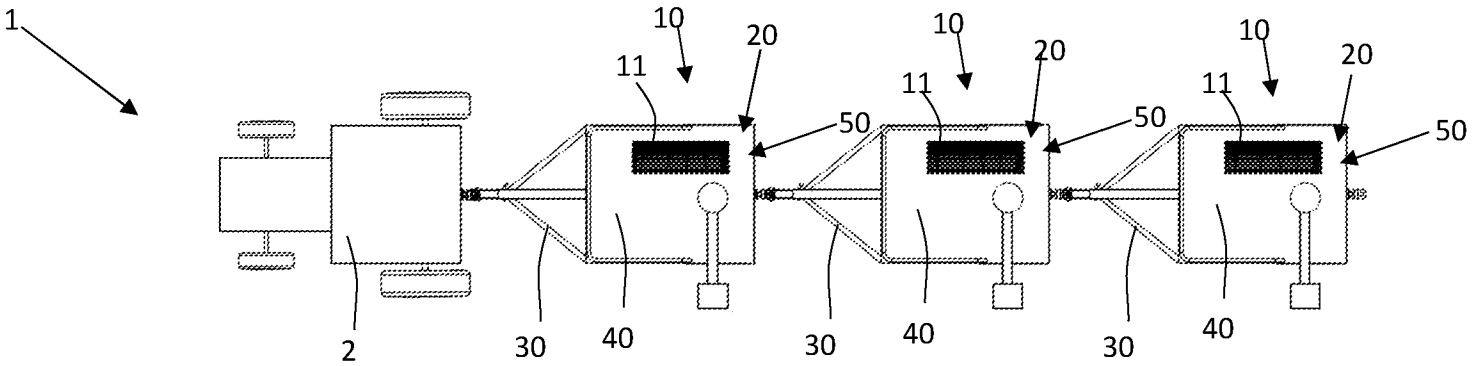
FIGS. 4A to 4D show a series of steps to anchor a number of posts into the ground for erecting a fence.

In use, an operator stands on each trailer and loads a post 11 into their respective anchoring mechanism 51. The post anchoring mechanisms 51 are, therefore, ready to anchor the posts 11 into the ground, as shown in FIG. 4A.

Figure 4B:
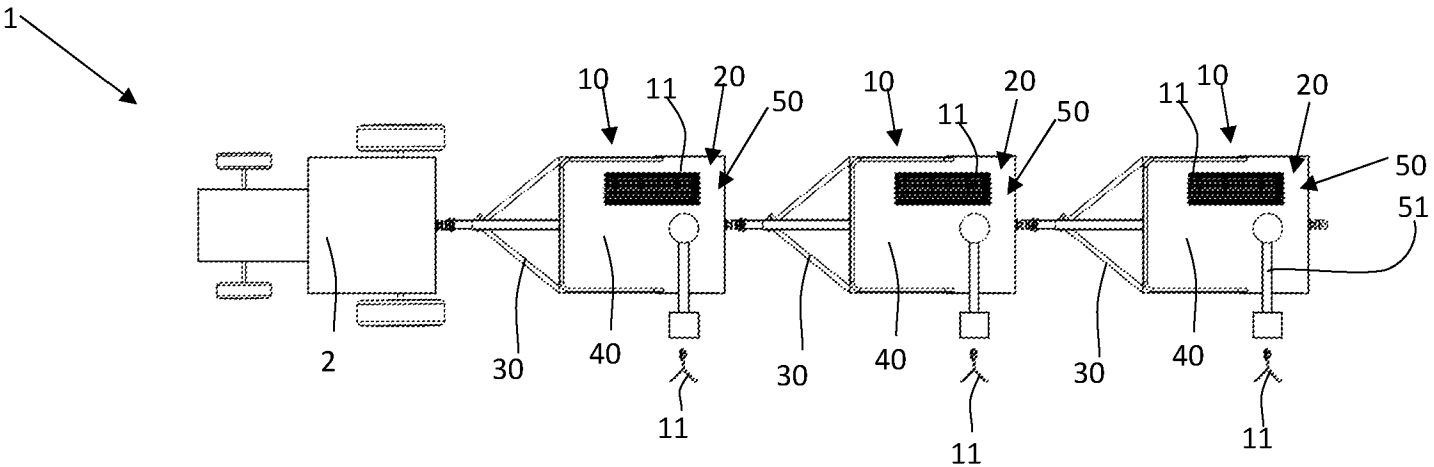

The powered vehicle 1 leads the trailers 10 along a predetermined fence line. When the powered vehicle 1 is in a desired position, the vehicle stops, and the operators are told they are in the correct position. The operators then simultaneously anchor in the posts 11 into the ground using their respective anchoring mechanisms 51, as shown in FIG. 4B.

Figure 4C:
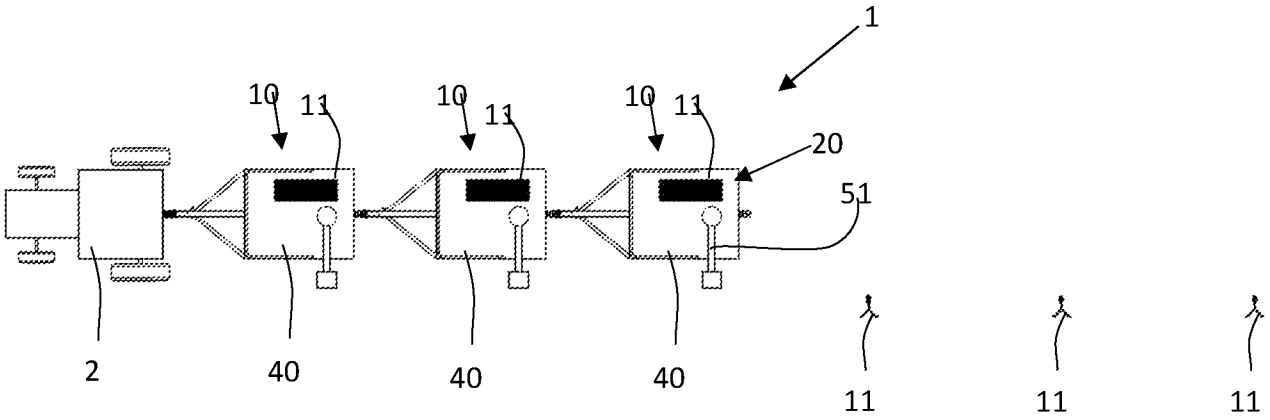

Once all of the posts 11 have been anchored to the ground, and the anchor mechanism 51 has been withdrawn from the anchored posts 11, the powered vehicle 1 moves to the next desired location. Simultaneously, the posts 11 are loaded, by the operators, into the empty post anchoring mechanisms 51 on each trailer as shown in FIG. 4C.

Figure 4D:
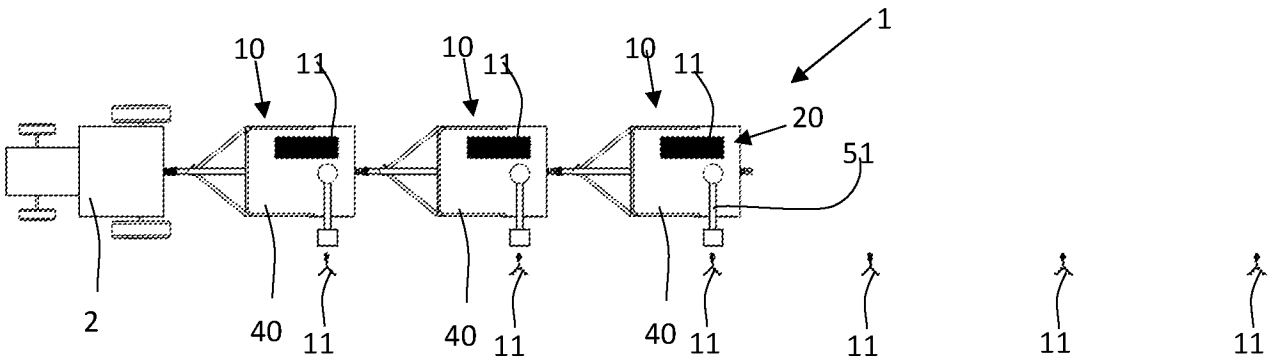

When the next location along the fence line is reached by the powered vehicle 1, this is again indicated to the operators, and posts are anchored into the ground by the operators using the anchoring mechanisms 51 as shown in FIG. 4D. This process is repeated until the posts for fences are all anchored into the ground.

The distance that the powered vehicle 1 moves largely depends on the spacing between the posts 11 and the number of anchoring stations 50. For example, if the fence posts 11 are to be anchored at seven-metre centres, and there are seven anchoring stations, the powered vehicle will anchor forward 49 metres and stop. The seven operators on each of the trailers 10 would then each install one post per anchoring station using the associated anchoring mechanism.

This method enables seven posts 11 to be installed substantially at one time 'covering 49 meters, with all posts being installed substantially in alignment with the desired fence line, with each post being substantially perpendicular. It would be appreciated that the spacing between the anchoring stations may be varied by the length of the telescopic arm.

It is envisaged that each trailer may have one, two or three anchoring stations 50 and therefore can anchor one, two or three posts substantially at the same time. The fence posts are be installed substantially "IN-LINE" along a predetermined fence line. It would also be appreciated that designated strainer posts or in-line mid strainer posts can be installed, when required, by any of the various anchoring stations.

It would also be appreciated that the trailer shown in FIG. 3 may replace the trailers shown in FIGS. 1 and 4 to perform the described installation method. The only difference between the methods being the actions performed by the operators on the trailers would be performed automatically and controlled by an operator normally located in the powered vehicle 1.

Figure 5A:
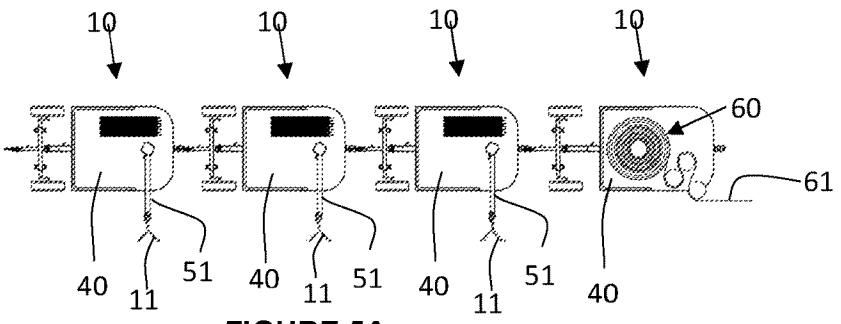
FIGS. 5A to 5C show a series of steps to erect a fence.
Figure 5B:
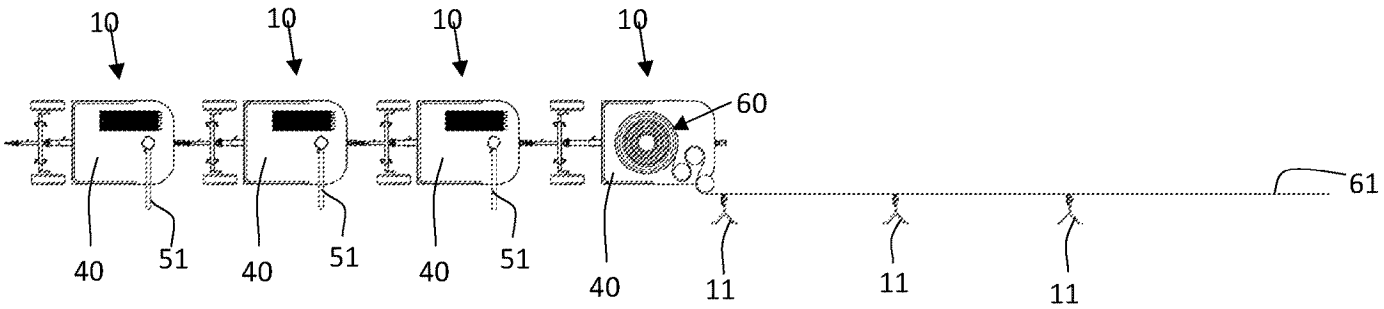
Figure 5C:
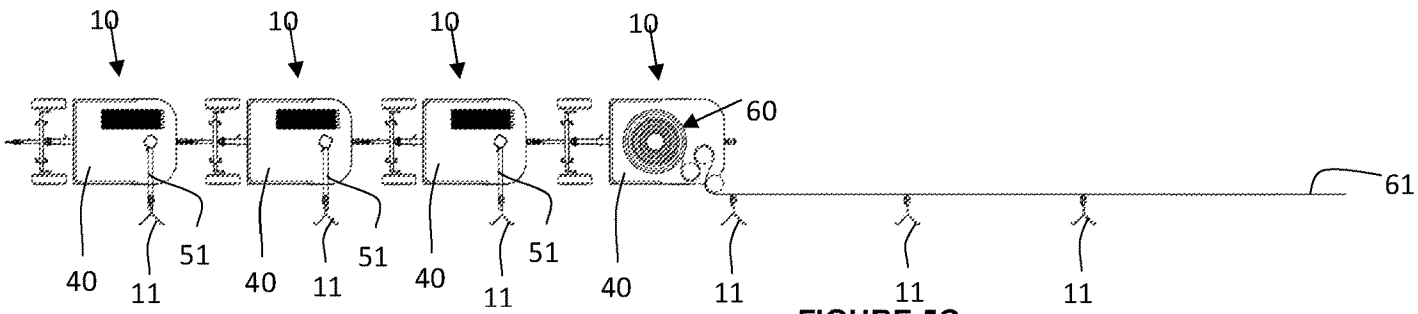

FIG. 5A to FIG. 5C show a further embodiment of a vehicle train 1.

In this embodiment, this last trailer is used to mount a barrier material feeder 60. The barrier material feeder 60 feeds material 61 out of the barrier material feeder 60 when the powered vehicle 1 is anchored forwards as shown in FIG. 5B. The barrier material feeder does not feed barrier material out when posts are being anchored (shown in FIGS. 5A and 5C). The barrier material feeder 61 can feed the desired barrier material depending on the desired fence.

The barrier material 61 is strained at appropriate locations using strainer posts (not shown) that would be evident to a person skilled in the art. The barrier material is then connected to posts 11 that have been anchored into the ground to complete installation of a fence.

Figure 6:
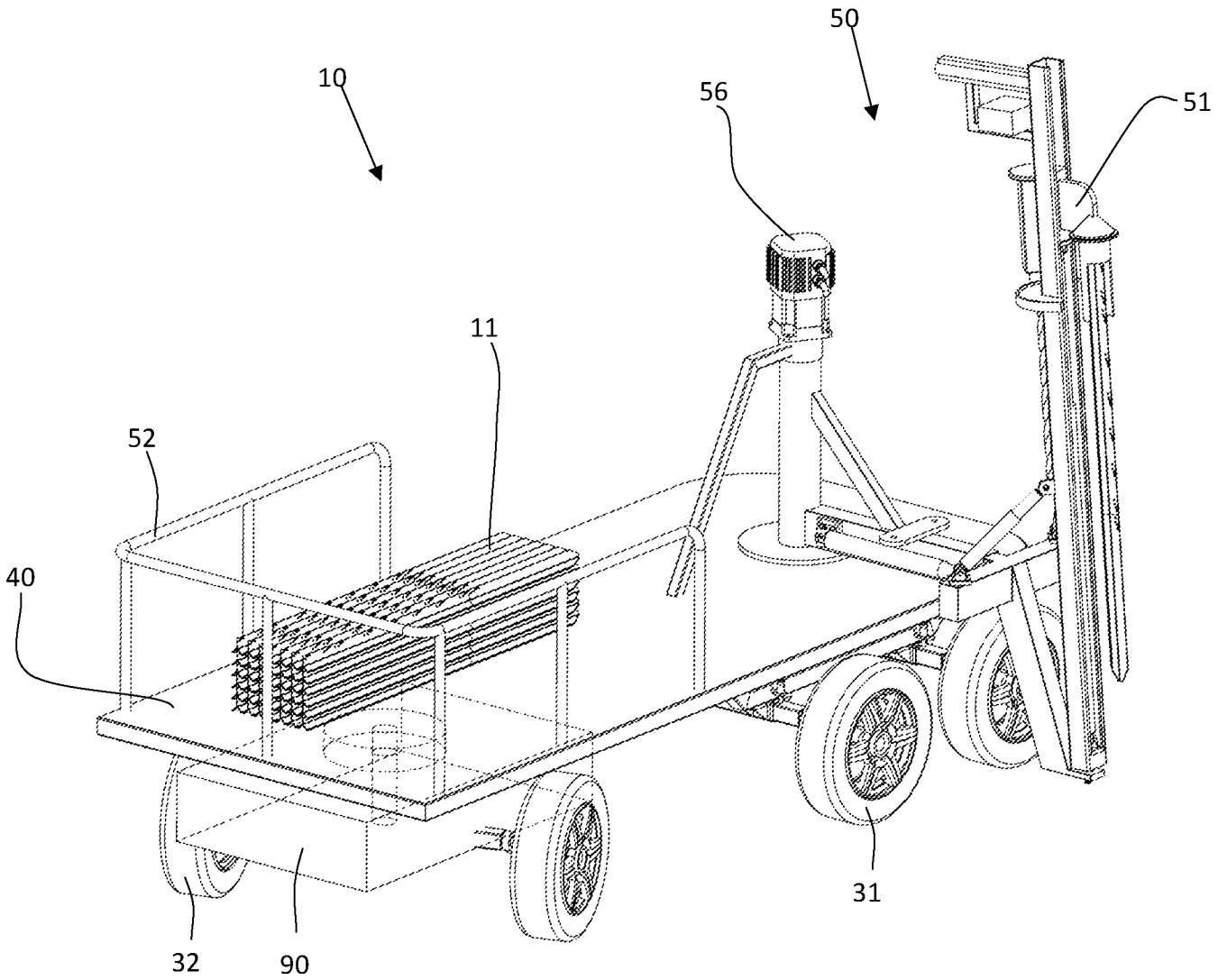
FIG. 6 is a perspective view of a second embodiment of a movable platform according to an embodiment of the invention.

FIG. 6 shows an autonomous or semi-autonomous movable platform 10 having a control and steering unit 90 configured to steer the front wheels 32. The control and steering unit 90 may be in communication, preferably wireless communication, with a remote control station and/or other movable platforms 10. The control and steering unit 90 can be utilised to manoeuvre the movable platform 10 independently, and preferably autonomously, from other movable platforms.

Figure 7:
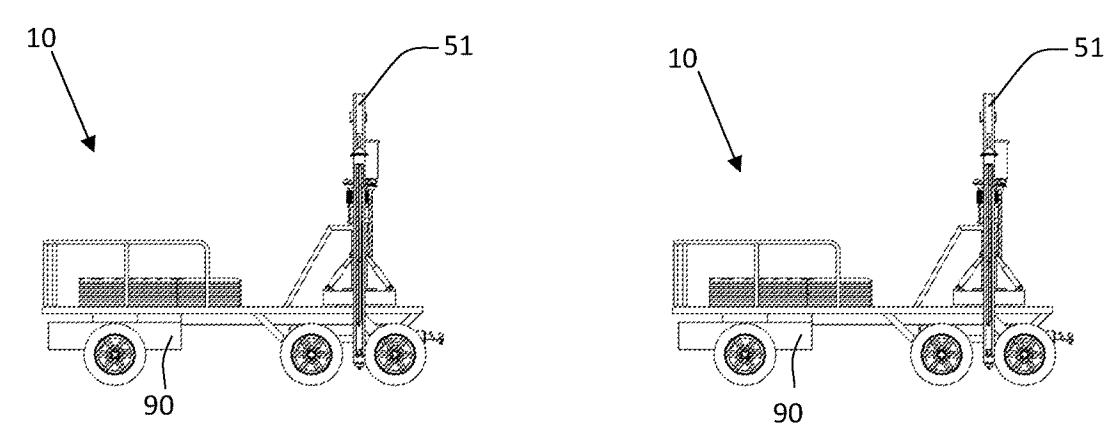
FIG. 7 illustrates a side view of plurality of movable platforms as illustrated in FIG. 6.
Figure 8:
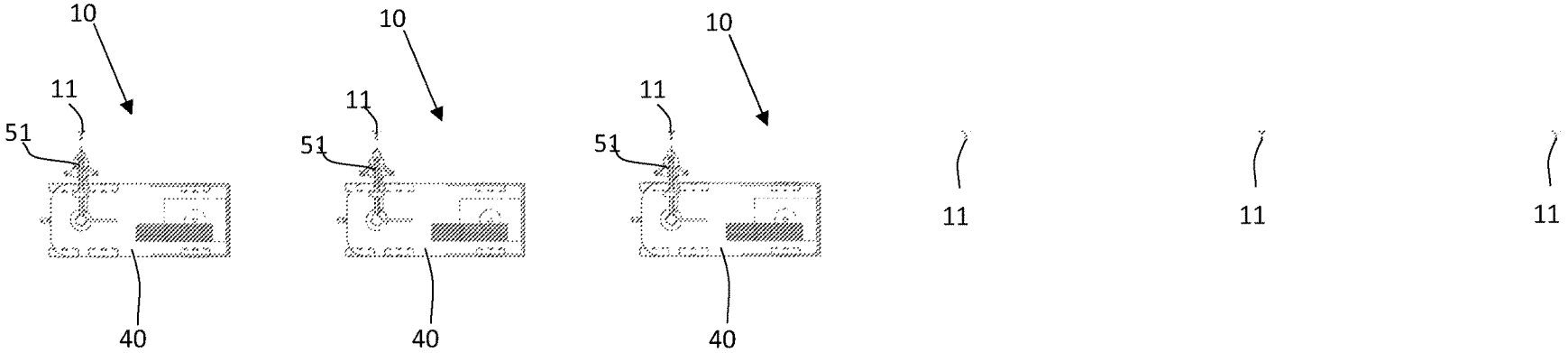
FIG. 8 illustrates a top view of the plurality of movable platforms of FIG. 7 anchoring a number of posts into the ground for erecting a fence.

FIG. 7 illustrates a plurality of autonomous or semi autonomous movable platforms 10 in series. Although there is no mechanical interconnection, the movable platforms 10 are operatively connected via wireless communication to operate collaboratively. FIG. 8 illustrates the autonomous or semi autonomous movable platforms 10 in operation.

Figure 9:
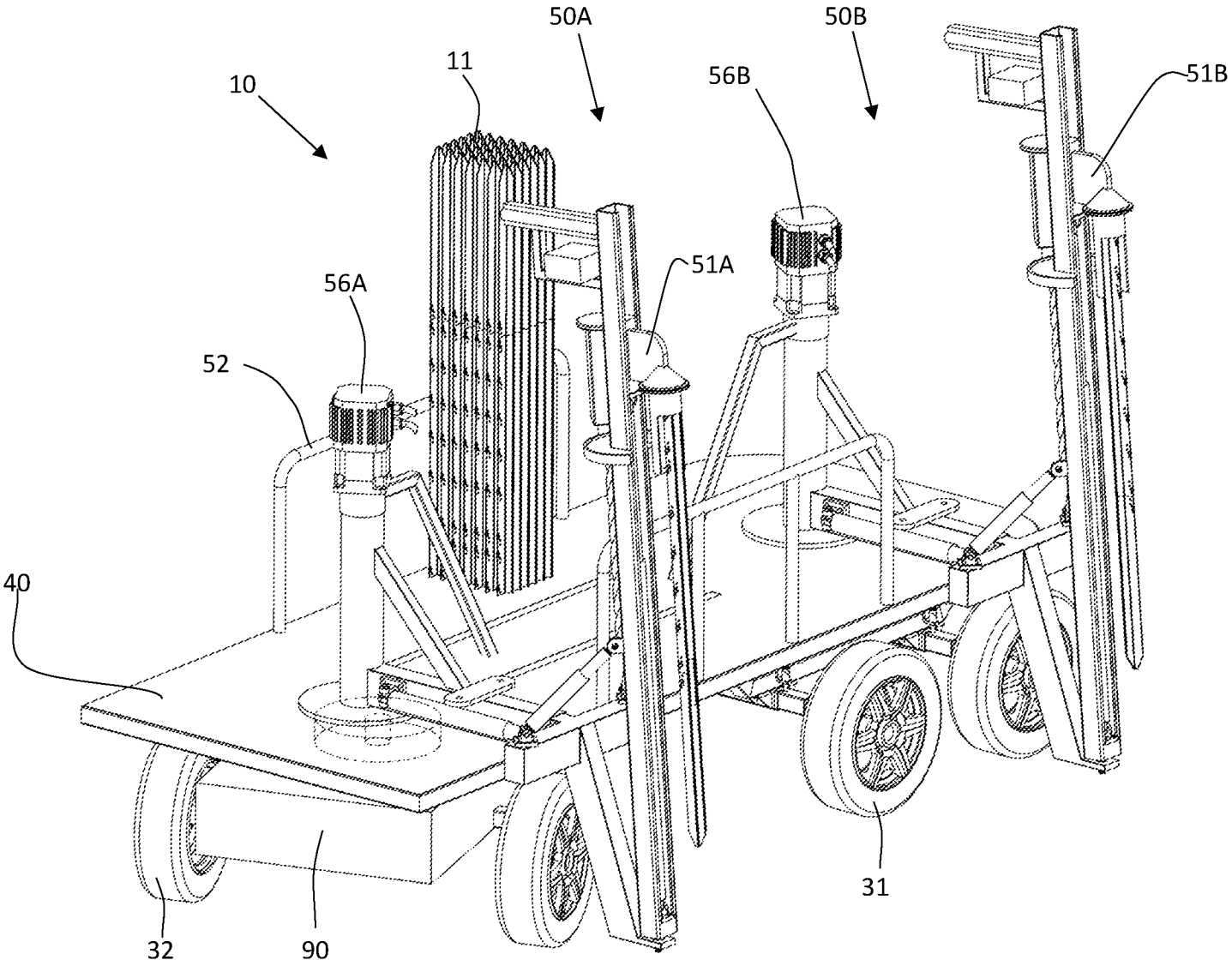
FIG. 9 is a perspective view of an embodiment of a movable platform with multiple anchoring stations according to an embodiment of the invention.

FIG. 9 shows an autonomous or semi-autonomous movable platform 10 having multiple anchoring stations, namely a first anchoring station 51A and a second anchoring station 51B. It should be appreciated that further anchoring stations could be located on a single movable platform if desired. It should also be appreciated that although an autonomous or semi-autonomous movable platform is illustrated, a plurality of anchoring stations could be provided on platforms that are operatively connected through mechanical means as described earlier.

Figure 10:
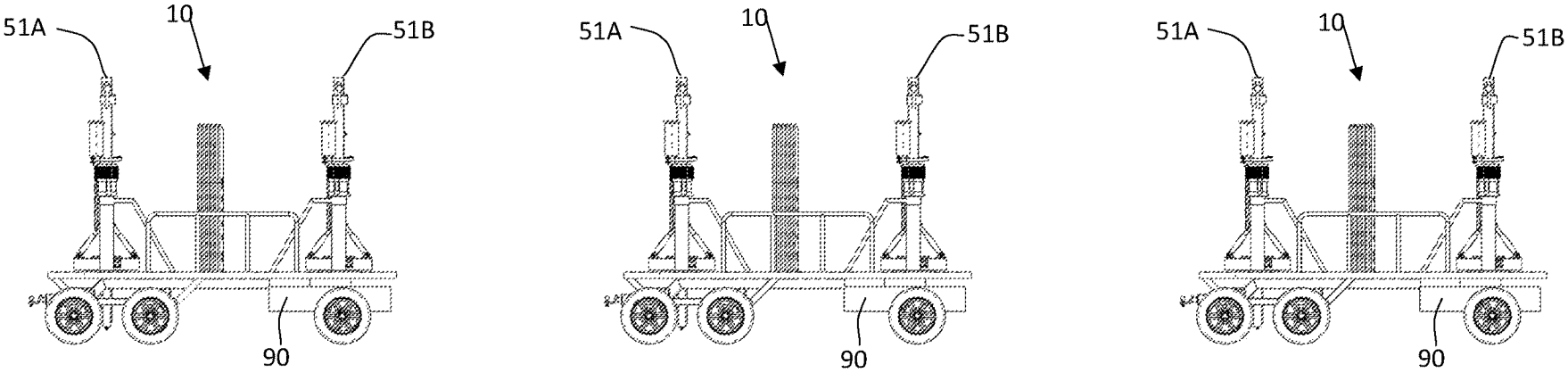
FIG. 10 illustrates a side view of plurality of movable platforms as illustrated in FIG. 9.
Figure 11:
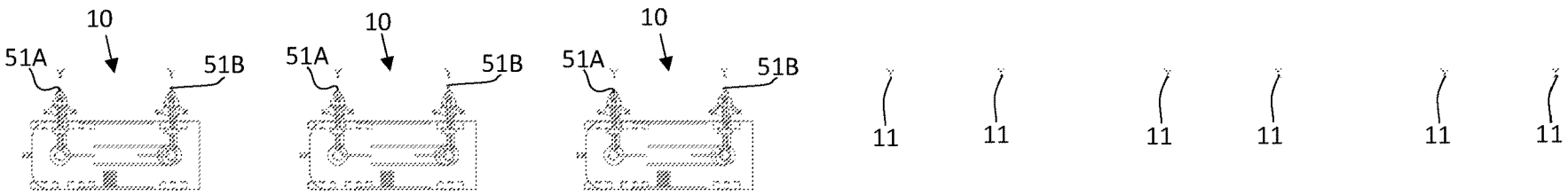
FIG. 11 illustrates a top view of the plurality of movable platforms of FIG. 10 anchoring a number of posts into the ground for erecting a fence.

FIG. 10 illustrates a plurality of the movable platforms 10 of FIG. 9 in a series. FIG. 8 illustrates the autonomous or semi autonomous movable platforms 10 in operation.

This method of anchoring posts into the ground to erect a fence or the associated method of erecting a fence can be formed substantially quicker than current methods. This is due to a large number of posts being able to be anchored into the ground simultaneously at a desired spacing along a predetermined fence line.

In this specification, the terms "comprise", "comprises", "comprising" or similar terms are intended to mean a non-exclusive inclusion, such that a system, method or apparatus that comprises a list of elements does not include those elements solely, but may well include other elements not listed.

The reference to any prior art in this specification is not, and should not be taken as, an acknowledgement or any form of suggestion that the prior art forms part of the common general knowledge.

It should be appreciated that various other changes and modifications may be made to the embodiments described without departing from the spirit or scope of the invention.

The invention claimed is:

1. A method of ground anchoring a plurality of posts, the method comprising:

anchoring a first plurality of posts into the ground using a plurality of post anchoring stations, the post anchoring stations being located on at least two movable platforms;

moving the at least two movable platforms along a predetermined path; and anchoring a second plurality of posts into the ground using the plurality of post anchoring stations, wherein:

the at least two movable platforms are operatively connected and aligned along the predetermined path;

of the at least two operatively connected movable platforms an interconnected movable platform is articulated with respect to the other movable platform or platforms; and each of the at least two movable platforms is a towed trailer.

2. The method of claim 1, wherein the first plurality of posts are anchored substantially simultaneously, and the second plurality of posts are anchored substantially simultaneously.

3. The method of claim 1, wherein each said towed trailer comprises a transportable chassis on which is mounted a floor, and on which floor is located one or more of the plurality of post anchoring stations.

4. The method of claim 1, wherein a propulsion unit is configured to tow the at least two movable platforms.

5. The method of claim 1, wherein:

a distance between respective post anchoring stations is independently varied;

a distance between respective post anchoring stations is varied by moving the post anchoring station position on one or more of the at least two movable platforms; or a distance between respective post anchoring stations is varied by changing the spacing between each or any one or more of the at least two movable platforms.

6. The method of claim 1, wherein:

each post anchoring station comprises a post anchoring mechanism that is independently capable of adjustment such that it can be configured to be operated on either side of a movable platform of the at least two movable platforms; or each post anchoring station comprises a post anchoring mechanism that is independently capable of adjustment such that it can extend or retract on a substantially horizontal plane perpendicularly from a movable platform of the at least two movable platforms.

7. The method of claim 1, wherein:

a barrier material is located on, and dispensed from, one or more of the at least two movable platforms;

a barrier material is located on, and dispensed from, a further operatively connected movable platform lacking a post anchoring station;

a barrier material is located on, and dispensed from, one or more of the at least two movable platforms, and the barrier material is connected to mid-strainer posts and/or end strainer posts; or a barrier material is located on, and dispensed from, a further operatively connected movable platform lacking a post anchoring station, and the barrier material is connected to mid-strainer posts and/or end strainer posts.

8. A method of erecting a fence, the method comprising:

anchoring a first plurality of posts into the ground using a plurality of post anchoring stations, the post anchoring stations being located on at least two movable platforms;

moving the at least two movable platforms along a predetermined fence line;

anchoring a second plurality of posts into the ground using the plurality of post anchoring stations;

laying out at least one length of barrier material adjacent the first plurality of posts and adjacent the second plurality of posts, and straining the at least one length of barrier material; and attaching the at least one length of barrier material to the first plurality of posts and the second plurality of posts, wherein:

the at least two movable platforms are operatively connected and aligned along the predetermined fence line;

of the at least two operatively connected movable platforms an interconnected movable platform is articulated with respect to the other movable platform or platforms; and each of the at least two movable platforms is a towed trailer.

9. The method of claim 8, wherein further operatively connected through a wireless communication system.

10. The method of claim 8, wherein such said towed trailer comprises a transportable chassis on which is mounted a floor, and on which floor is located one or more of the plurality of post anchoring stations.

11. The method of claim 8, wherein the first plurality of posts are anchored substantially simultaneously, and the second plurality of posts are anchored substantially simultaneously.

12. The method of claim 8, wherein:

the barrier material is located on, and dispensed from, one or more of the at least two movable platforms;

the barrier material is located on, and dispensed from, a further operatively connected movable platform lacking a post anchoring station;

the barrier material is located on, and dispensed from, one or more of the at least two movable platforms, and the barrier material is connected to mid-strainer posts and/or end strainer posts; or the barrier material is located on, and dispensed from, a further operatively connected movable platform lacking a post anchoring station, and the barrier material is connected to mid-strainer posts and/or end strainer posts.

13. A multi vehicle train that is used to anchor posts, the multi vehicle train comprising:

a plurality of operatively connected movable platforms; and a plurality of post anchoring stations, each post anchoring station comprising a post anchoring mechanism, wherein:

the plurality of post anchoring stations is located on at least two of the plurality of movable platforms;

the plurality of movable platforms is configured to be aligned along a predetermined path;

of the operatively connected plurality of movable platforms an interconnected movable platform is articulated with respect to other movable platforms; and each of the at least two platforms of the plurality of movable platforms is a towed trailer.

14. The multi vehicle train of claim 13, wherein one or more of the plurality of movable platforms is used to mount at least one barrier material feeder.

15. The multi vehicle train of claim 13, further comprising a propulsion unit configured to tow the plurality of movable platforms, or one more of the plurality of movable platforms comprises a propulsion unit.

16. The multi vehicle train of claim 13, wherein each said towed trailer comprises a transportable chassis on which is mounted a floor, and on which floor is located one or more of the plurality of post anchoring stations.

* * * * *